United States Patent [19]

Wahl et al.

[11] 4,428,367

[45] Jan. 31, 1984

[54] VIBRATORY ELECTRIC MOTOR AND APPLIANCE EMBODYING SAME

[75] Inventors: Gregory S. Wahl; Raymond H. Babel, both of Sterling, Ill.

[73] Assignee: Wahl Clipper Corporation, Sterling, Ill.

[21] Appl. No.: 433,456

[22] Filed: Oct. 8, 1982

[51] Int. Cl.[3] ..... A61H 23/02

[52] U.S. Cl. ..... 128/24.2; 128/41; 128/32

[58] Field of Search ..... 128/24.2, 33, 41, 24.5, 128/32; 310/21-22, 29, 32

[56] References Cited

U.S. PATENT DOCUMENTS

| | | | |
|---|---|---|---|
| 2,840,071 | 6/1958 | McNair | 128/41 |
| 2,921,578 | 1/1960 | Rabhan | 128/33 |

FOREIGN PATENT DOCUMENTS

| | | | |
|---|---|---|---|
| 8102762 | 6/1981 | Netherlands | 128/32 |
| 848491 | 6/1959 | United Kingdom | 128/33 |

*Primary Examiner*—Richard J. Apley
*Assistant Examiner*—Chris Coppens
*Attorney, Agent, or Firm*—Emrich & Lee and Brown, Hill, Dithmar, Stotland, Stratman & Levy

[57] ABSTRACT

A vibratory electric motor and appliance embodying same contemplates a pair of shallow pan members which are reversely secured together by means of peripheral portions thereof. The pan members have spaced and aligned generally parallel portions within the peripheral portions which cooperate to mount the vibratory motor. The latter is more or less conventional except that the armature leg which is spaced by a gap from the pole faces of the core-coil assembly has an enlarged width about equal to the spacing between the parallel portions of the pan members. Each side of this widened armature leg has a pair of spaced projections which respectively enter apertures in the parallel portions of the pan members. Thus, when the pan members are secured together at the peripheral portions thereof, the motor is firmly mounted in engagement with both pan members, thereby avoiding auxiliary mounting parts and the assembly time required to install such parts. Also, the appliance is strengthened due to the relationship between the widened armature leg of the motor and the pan members. Also, in some instances the portions of the pan members containing the projection-receiving apertures are inwardly embossed, whereby the strength of the pan members where the motor is mounted is increased further.

2 Claims, 5 Drawing Figures

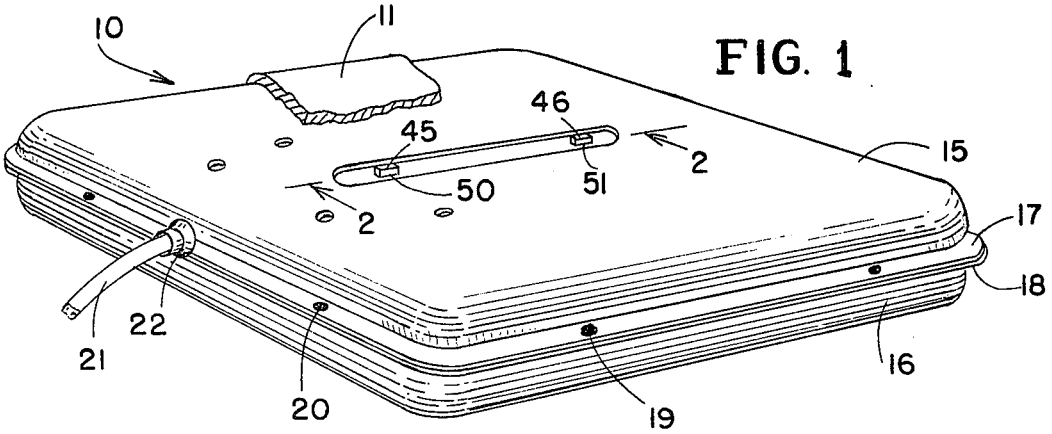
FIG. 1
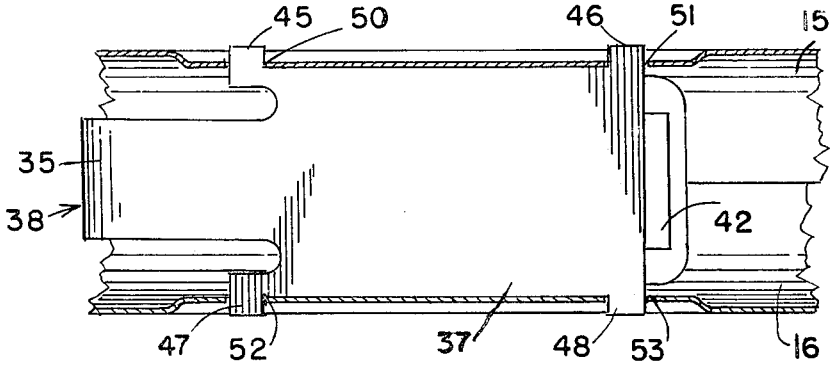
FIG. 2
FIG. 4
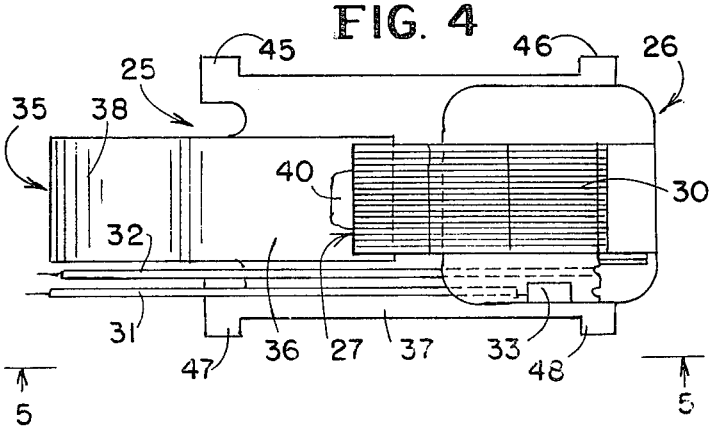
FIG. 3
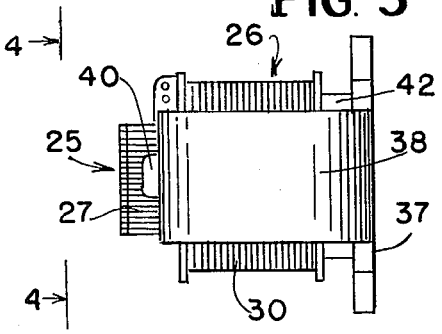
FIG. 5
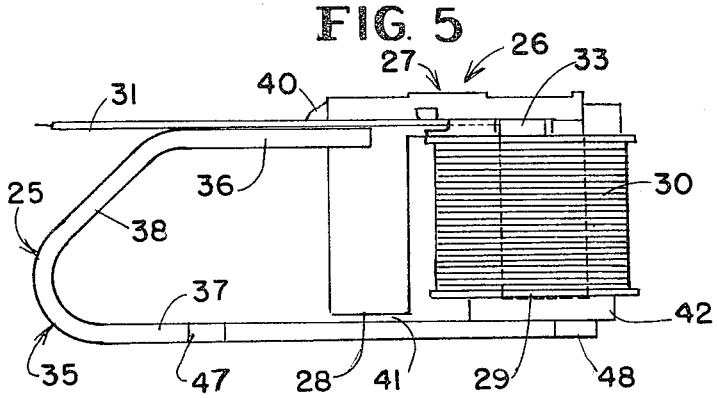

VIBRATORY ELECTRIC MOTOR AND APPLIANCE EMBODYING SAME

BACKGROUND OF THE INVENTION

This invention relates to a vibratory electric motor and an appliance embodying same, and more particularly to motor structure and appliance structure which cooperate to mount the motor firmly within the appliance, whereby mounting parts and assembly time are eliminated or minimized, and the appliance is strengthened due to the relationship between motor and appliance.

Prior vibratory electric motors and vibratory appliances embodying same have been proposed. Examples thereof are disclosed in U.S. Pat. Nos. 2,920,618; 4,006,739 and 4,022,195. The latter two patents are owned by the assignee of the present application. The experience of the common assignee in connection with commercial products made under the latter two patents has inspired the present invention.

In particular, the vibratory motors and appliances previously produced by the common assignee have utilized separate motor mounting parts and time-consuming assembly techniques which account for considerable expense in the overall cost of the assembled motor and vibratory applicance.

SUMMARY OF THE INVENTION

One object of the invention, therefore, is to provide a vibratory electric motor and an appliance embodying same wherein the motor itself attaches to the appliance without requiring extraneous mounting parts or time-consuming steps in mounting the motor firmly within the appliance.

Another object of the invention is to utilize mechanical strength inherent in the motor for increasing the strength of the appliance in which the motor is mounted.

Still another object of the invention is to strengthen the appliance further by employing bosses in the appliance where the motor is mounted. The bosses, of course, inherently increase the strength of the appliance, and thus augment the aforesaid strengthening provided by the motor itself.

In brief, the present invention contemplates modifications in both a vibratory electric motor and an appliance embodying same, the modifications serving to eliminate mounting parts and time-consuming assembly steps.

The vibratory appliance of the invention has a pair of shallow pan members reversely secured together by means of peripheral portions thereof, thereby providing a casing which encloses the vibratory electric motor. The pan members have spaced and aligned generally parallel portions within the peripheral portions, and the vibratory electric motor has a core-coil assembly with spaced pole faces and a generally C-shaped armature. The armature has a pair of spaced legs and a resilient web connecting corresponding ends of the legs. A first armature leg is connected in flux-conducting manner to a core portion opposite the pole faces, and the second armature leg is spaced by a gap from the pole faces. The above-mentioned motor and appliance features are more or less conventional, and are generally shown in the U.S. patents mentioned above.

The present invention contemplates the combination of the aforesaid conventional elements with a means for mounting the vibratory electric motor firmly within the appliance, the mounting means comprising a pair of spaced apertures in the generally parallel portions of the pan members, the apertures in one pan member being generally opposite the apertures in the other pan member.

Referring to the C-shaped armature in the vibratory electric motor, the second armature leg is sized in width to exceed the width dimension of the core-coil assembly, the sides of the second armature leg which define the armature width being disposed adjacent the generally parallel portions of the pan members and the apertures therein. A pair of projections extend from each said side of the second armature leg, and these projections are located to enter adjacent apertures and thus mount the motor firmly within the pan members. Thus, when the pan members are secured together by means of the peripheral portions thereof, the motor is firmly mounted with respect to the pan members. Thus, motor mounting parts previously used and assembly time previously expended are minimized, and, in addition, the second armature leg serves to strengthen the pan members.

In more detailed aspect, the generally parallel portions of the pan members having the apertures may be inwardly embossed, whereby the clearance between the core-coil assembly and the pan members is increased, and the strength of the pan members where the motor is mounted also is increased.

The invention consists of certain novel features and combination of parts hereinafter described, illustrated in the accompanying drawings and particularly pointed out in the appended claims, it being understood that various changes in the details may be made without departing from the spirit or sacrificing any of the advantages of the present invention.

BRIEF DESCRIPTION OF THE DRAWINGS

FIG. 1 is a perspective view of an appliance embodying the present invention, the vibratory electric motor being mounted between the top and bottom pan members shown in FIG. 1.

FIG. 2 is a fragmentary sectional view taken on line 2—2 of FIG. 1.

FIG. 3 is an end view of the vibratory electric motor containing modifications which characterize the invention.

FIG. 4 is a top view of the motor shown in FIG. 3, the view being taken from the left of FIG. 3 generally on line 4—4.

FIG. 5 is a side view of the vibratory electric motor shown in FIGS. 3 and 4, the view being taken generally on line 5—5 of FIG. 4.

DETAILED DESCRIPTION

Referring to FIG. 1 of the drawing, a vibratory appliance embodying the invention is designated 10. In finished form, appliance 10 includes a suitable covering 11 which is broken away for the most part so mechanical details of the invention can be shown.

As shown in the drawing, appliance 10 includes a pair of shallow metal pan members 15 and 16 which when assembled are reversely oriented and secured together by means of peripheral portions thereof. The peripheral portion of upper pan member 15 is designated 17 while that of lower pan member 16 is designatted 18.

The peripheral portions 17 and 18 of the pan members 15 and 16, as shown in FIG. 1, are spot welded together by means of spaced welds 19 and 20, although other securing means may be employed if desired. Alternatively, suitable means may be employed between the peripheral portions 17 and 18 of the assembled pan members 15 and 16 for mounting the appliance in cooperating apparatus.

Still referring to FIG. 1, the vibratory electric motor between the pan members is energized through an electrical conductor 21 which enters the space between pan members 15 and 16 through a strain gromment 22 secured in an opening provided in peripheral portions 17 and 18 and the adjacent portions of pan members 15 and 16.

Referring to FIGS. 3–5, the modified vibratory electric motor forming part of the invention next will be described. The motor shown in those figures is generally designated 25.

As best shown in FIG. 5, vibratory motor 25 includes a generally conventional core-coil assembly 26. As shown, core-coil assembly 26 includes a generaly U-shaped core 27 made up of metal laminations, the core having a pair of spaced pole faces 28 and 29, best shown in FIG. 5. Wire coil 30, as shown, surrounds the pole of core 27 which has pole face 29.

Leads 31 and 32 extend from the ends of coil 30 to conductor 21 (FIG. 1) as best shown in FIG. 4. A rectifier diode 33 is mounted adjacent to coil 30 and is connected between lead 31 and one end of coil 30.

Motor 25 also includes a more or less conventional armature which is generally designated 35 in FIG. 5. Armature 35 is generally C-shaped, the armature having spaced legs 36 and 37 and a resilient web 38 connecting corresponding ends of the legs 36 and 37.

As best shown in FIGS. 4 and 5, armature leg 36, hereinafter sometimes referred to as the first armature leg, is connected to a portion of core 27 opposite to pole faces 28 and 29. As shown in FIG. 5, a slot is provided in core 27 and the free end of armature leg 36 enters the slot. Leg 36 is secured in the slot by suitable means such as weld 40. Armature leg 37 is spaced by a gap 41 from pole face 28, and a corresponding gap is present between armature leg 37 and pole face 29. Resilient material 42 is disposed between armature arm 37 and pole face 29 to minimize noise.

As shown in FIGS. 3 and 4, armature arm 37 which is disposed adjacent pole faces 28 and 29 is enlarged in width compared to armature arm 36 and armature web 38. In fact, second armature leg 37 is sized in width to exceed the width dimension of the core-coil assembly 26. More specifically, the width of second armature leg 37 is generally equal to the perpendicular distance between the generally parallel portions of pan members 15 and 16 employed in mounting motor 25. Thus, when motor 25 is assembled within pan members 15 and 16, the sides of second armature leg 37 which define the armature width are disposed adjacent the aforesaid generally parallel portions of the pan members.

Each side of second armature leg 37 has a pair of projections, the projections on one side being designated (FIG. 4) 45 and 46, and the projections on the other side being designated 47 and 48.

The generally parallel portions of pans 15 and 16 where motor 25 is mounted each have pair of spaced apertures, the apertures in one pan member being generally opposite the apertures in the other pan member. Only one pair of apertures is shown in FIG. 1, these being the apertures in pan member 15 which receive projections 45 and 46 from second armature leg 37. The apertures in the two pan members are best shown in FIG. 2 where they receive projections 45–48 and are designated 50, 51, 52 and 53.

The reception of projections 45–48 within apertures 50–53 of the pan members 15 and 16 serves to mount motor 25 firmly between pan members 15 and 16. This mounting arrangement eliminates motor mounting parts heretofore used and minimizes assembly time for mounting motor 25 within the pan members. Also, the second armature leg 37 in engagement with generally parallel portions of pan members 15 and 16 serves to strengthen the pan members in the region where the motor 25 is mounted.

As shown in FIGS. 1 and 2, the generaly parallel portions of pan members 15 and 16 which have the apertures 50–53 are inwardly embossed, whereby the clearance between the core-coil assembly 26 and the pan members 15 and 16 is increased, and the strength of the pan members where motor 25 is mounted is also increased.

From the above description, it is believed that the construction and advantages of the invention will be readily apparent to those skilled in the art. Various changes in detail may be made without departing from the spirit or losing the advantages of the invention.

Having thus described the invention, what is claimed as new and desired to be secured by Letters Patent is:

1. In a vibratory electric motor and an appliance embodying same wherein the appliance has a pair of shallow pan members reversely secured together by means of peripheral portions thereof, the pan members having spaced and aligned generally parallel portions within the peripheral portions and wherein the vibratory electric motor has a core-coil assembly with spaced pole faces and a generally C-shaped armature having spaced legs and a resilient web connecting corresponding ends of the legs, a first armature leg being connected to a core portion opposite the pole faces and the second armature leg being spaced by a gap from the pole faces, the combination thereof with a means for mounting the vibratory electric motor firmly within the pan members, said mounting means comprising:

a pair of spaced apertures in the generally parallel portions of the pan members, the apertures in one pan member being generally opposite the apertures in the other pan member;

the second armature leg being sized in width to exceed the width dimension of the core-coil assembly, the sides of said second armature leg which define the armature width being disposed adjacent the generally parallel portions of the pan members and the apertures therein, and a pair of projections on each said side of the second armature leg adapted to enter adjacent apertures and thus mount the motor firmly within the pan members, whereby mounting parts and assembly time are minimized, and the second armature leg serves to strengthen the pan members.

2. The combination of claim 1 wherein the generally parallel portions of the pan members having the apertures are inwardly embossed, whereby the clearance between the core-coil assembly and the pan members is increased, and the strength of the pan members where the motor is mounted also is increased.

* * * * *